US009356378B1

(12) United States Patent
Glick et al.

(10) Patent No.: US 9,356,378 B1
(45) Date of Patent: May 31, 2016

(54) ELECTRIC CONNECTOR HOUSING WITH A TERMINAL INTERFACE

(71) Applicant: Lear Corporation, Southfield, MI (US)

(72) Inventors: Michael Glick, Farmington Hills, MI (US); Bhupinder Rangi, Novi, MI (US); David Menzies, Linden, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 14/620,304

(22) Filed: Feb. 12, 2015

(51) Int. Cl.

| | |
|---|---|
| ***H01R 9/05*** | (2006.01) |
| ***H01R 13/42*** | (2006.01) |
| ***H01R 43/20*** | (2006.01) |
| ***H01R 13/502*** | (2006.01) |

(52) U.S. Cl.
CPC ..... *H01R 13/42* (2013.01); *H01R 13/502* (2013.01); *H01R 43/20* (2013.01)

(58) Field of Classification Search
CPC ..... H01R 24/545; H01R 9/05; H01R 13/567; H01R 24/38; H01R 43/20; H01R 13/6277
See application file for complete search history.

(56) References Cited

U.S. PATENT DOCUMENTS

| | | | | |
|---|---|---|---|---|
| 5,647,772 | A | 7/1997 | Martucci et al. | |
| 6,386,903 | B1 | 5/2002 | Grossman | |
| 8,597,062 | B2 * | 12/2013 | Casses | H01R 4/184 439/686 |

* cited by examiner

*Primary Examiner* — Xuong Chung Trans
(74) *Attorney, Agent, or Firm* — MacMillan, Sobanski & Todd, LLC

(57) ABSTRACT

A method to assemble an electric connector includes inserting a terminal assembly with a wire attached thereto into a wire opening defined by a connector body. The terminal assembly is moved in an insertion direction to engage a terminal guide and is moved in a seat direction. The terminal assembly is moved further in the insertion direction to a seated position.

19 Claims, 5 Drawing Sheets

ELECTRIC CONNECTOR HOUSING WITH A TERMINAL INTERFACE

BACKGROUND OF THE INVENTION

This invention relates in general to an electric connector. More specifically, this invention relates to a terminal interface for a right angle electric connector.

Electric connectors may be used, for example, in completing electrical circuits with components in a power distribution box or connecting a wiring harness to an electrical device. These connectors may include a wire that is connected to a connector terminal. The connector terminal is designed to mate with a corresponding terminal located, for example, in the power distribution box. Some electric connectors include a connector terminal that mates with the corresponding terminal on a first axis, while the wire exits the connector on a second axis that is perpendicular to the first axis. These are known as right angle connectors because there is a ninety-degree angle between the terminal and the wire of the connector.

The wire is commonly connected to the connector terminal by crimping a portion of the connector terminal onto an end of the wire. This crimping helps maintain a good connection between the wire and the connector terminal. The connector terminal is typically fixed inside a connector housing in order to help prevent damage to the electric connector and to maintain proper mating between the connector terminal and the corresponding terminal. For example, the connector terminal should not pull out of the connector housing if the wire is tugged or pulled. Assembling these electric connectors can require inserting the wire end through a wire opening in the connector housing prior to crimping the connector terminal onto the end of the wire. It would be advantageous to have an electric connector that is easier to assemble.

SUMMARY OF THE INVENTION

This invention relates to a method to assemble an electric connector. The method includes inserting a terminal assembly with a wire attached thereto into a wire opening defined by a connector body. The terminal assembly is moved in an insertion direction to engage a terminal guide and then is moved in a seat direction. The terminal assembly is then moved further in the insertion direction to a seated position.

This invention also relates to an electric connector. The electric connector includes a connector body that defines a wire opening having a wire opening axis. The electric connector also includes an insulator attached to the connector body. The insulator has a rear surface and a terminal seat. The terminal seat is located closer to the wire opening axis than the rear surface is. The insulator also has a terminal guide that extends between the rear surface and the terminal seat. The electric connector includes a terminal assembly that is located on the terminal seat. Also, a wire is attached to the terminal assembly and has a wire axis that is coaxial with the wire opening axis.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
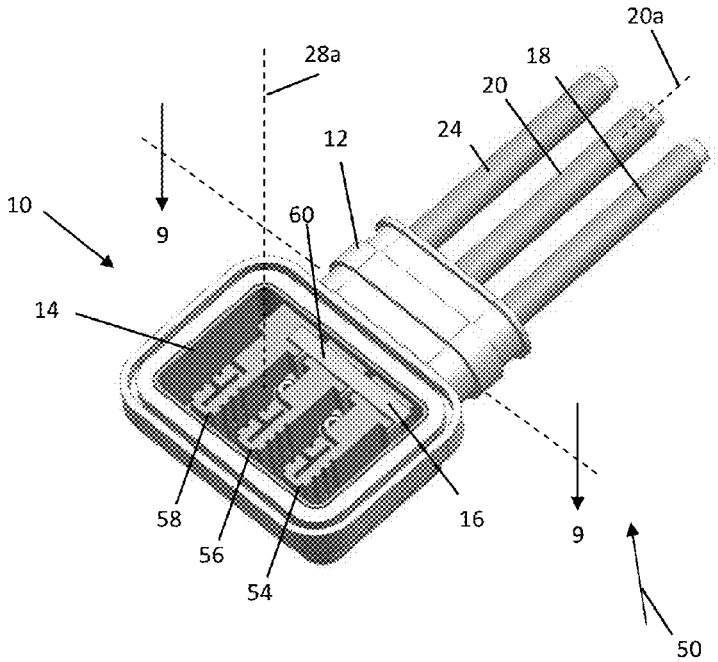
FIG. 1 is a perspective view of an electric connector.

Referring now to the drawings, there is illustrated in FIG. 1 a perspective view of an electric connector, indicated generally at 10. The electric connector 10 includes a connector body 12. The illustrated connector body 12 is made of aluminum but may be made of any desired material. The electric connector 10 includes an insulator 14 that is attached to the connector body 12. Alternatively, the insulator 14 may be an integral part of the connector body 12. The illustrated insulator 14 is a single piece of molded plastic, but may be made of any desired materials and by any desired method. The electric connector 10 also includes a terminal lock 16. The illustrated terminal lock 16 is made of plastic, but may be made of any desired material. The electric connector 10 includes three insulated wires 18, 20, and 24. It should be appreciated that the electric connector 10 may include any desired number of wires.

Figure 2:
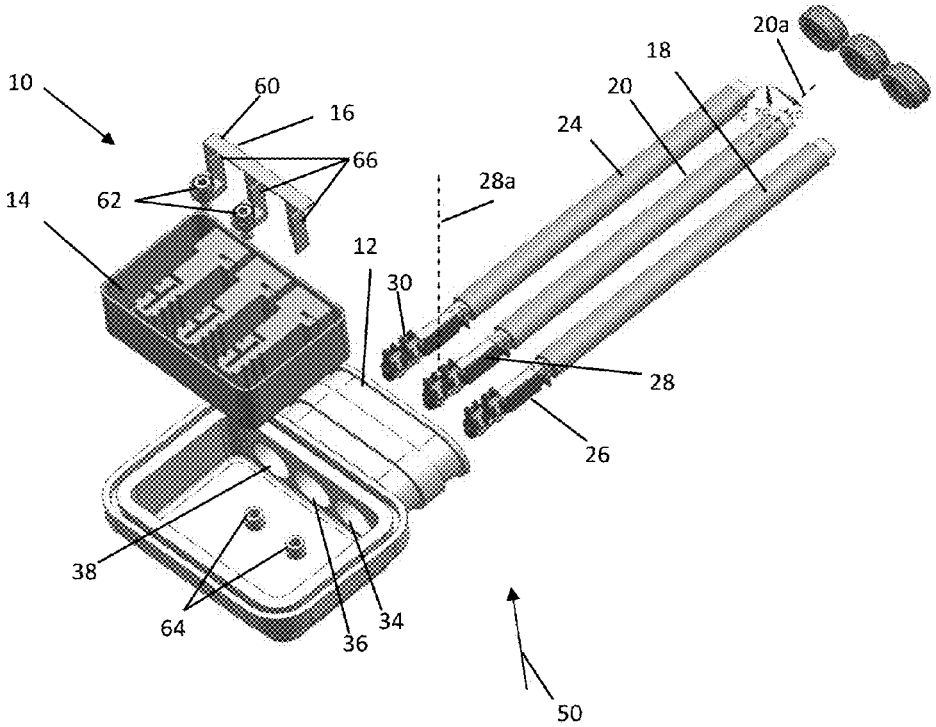
FIG. 2 is an exploded perspective view of the electric connector shown in FIG. 1.

Referring now to FIG. 2, an exploded perspective view of the electric connector 10 is shown. As shown, the wires 18, 20, and 24 are connected to respective electric terminal assemblies 26, 28, and 30. The electric connector 10 may include any desired number of terminal assemblies. The electric terminal assembly 28 is adapted to engage a corresponding terminal (not shown) that mates with the electric terminal assembly 28 by movement along a terminal axis 28*a*. The wire 20 connected to the electric terminal assembly 28 extends from the connector body 12 along a wire axis 20*a*. The terminal axis 28*a* and the wire axis 20*a* are substantially perpendicular, and the illustrated electric connector 10 is known as a right-angle connector. However, the terminal axis 28*a* and the wire axis 20*a* may have any desired relative orientation.

Figure 3:
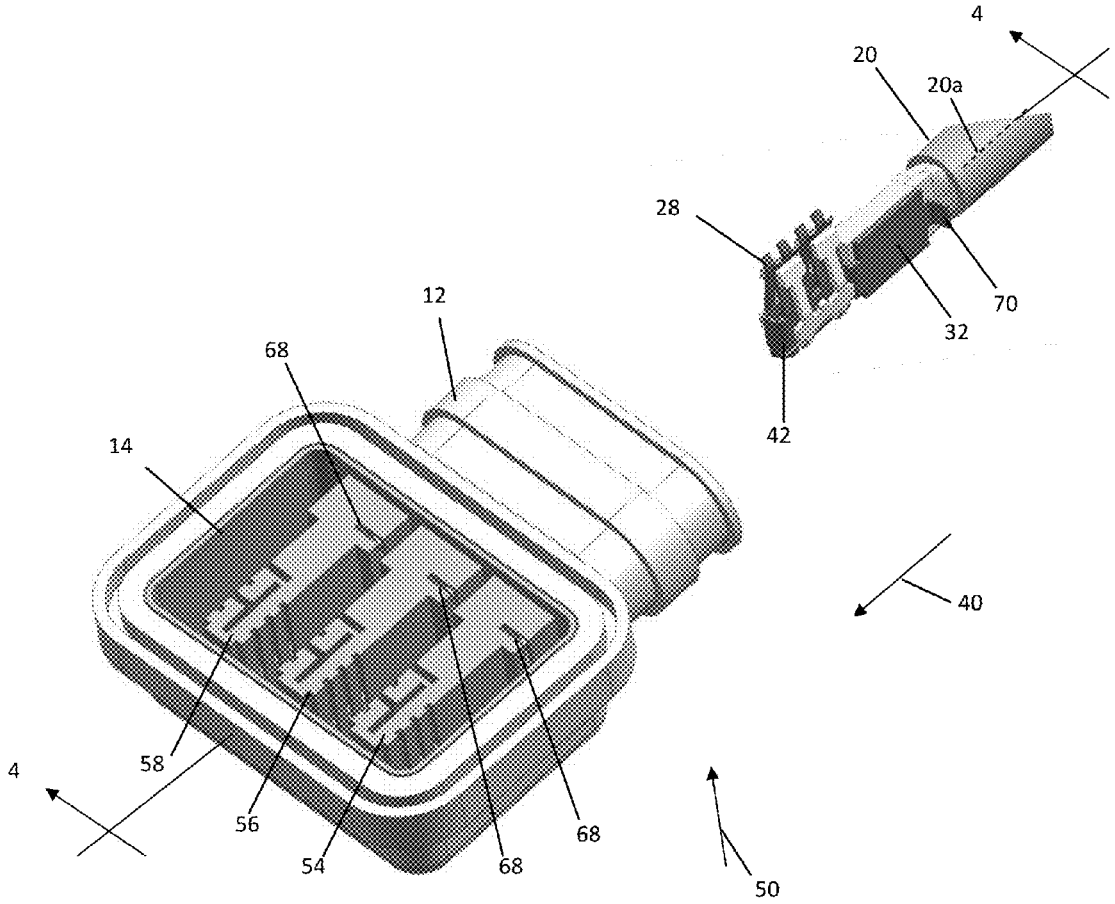
FIG. 3 is an enlarged exploded perspective view of some of the components of the electric connector shown in FIG. 2 prior to assembly.

Referring now to FIG. 3, the insulator 14 is shown mounted in the connector body 12. The illustrated insulator 14 is press-fit in the connector body, but may be attached by any desired fastener. The electric terminal assembly 28 with the wire 20 connected is positioned to be inserted into the connector body 12. The illustrated wire 20 is connected to the electric terminal assembly 28 by crimping a termination portion 32 of the electric terminal assembly 28 onto an end of the wire 20. However, the wire 20 may be connected to the electric terminal assembly 28 using any desired fastener or method. The illustrated electric terminal assembly 28 is a female-type electric terminal, but may be any desired type of electric terminal.

As best seen in FIG. 2, the connector body 12 defines three wire openings, 34, 36, and 38. The electric terminal assemblies 26, 28, and 30 are adapted to be respectively inserted into the wire openings 34, 36, and 38. The illustrated wire openings 34, 36, and 38 have substantially circular cross-sectional shapes, but they may have any desired shape. However, the illustrated circular cross-sectional shape is advantageous for sealing the wire openings 34, 36, and 38, as will be described below.

Figure 4:
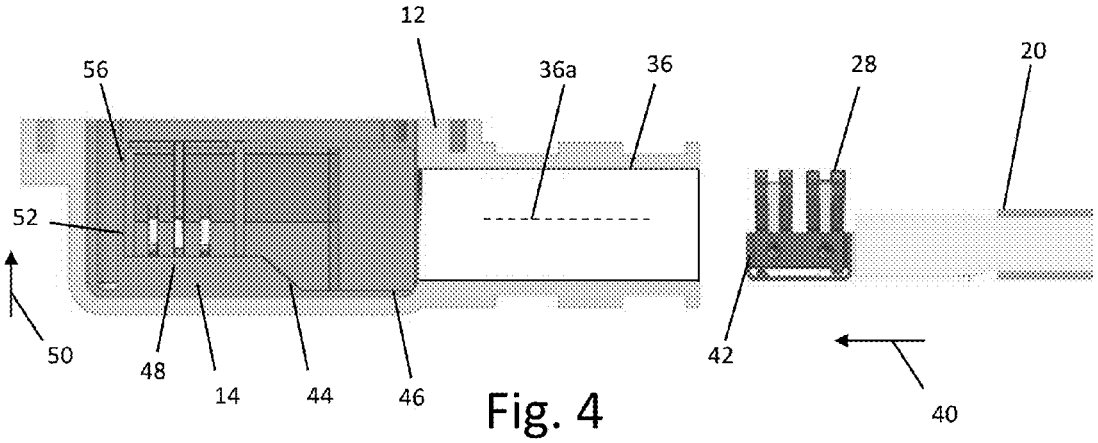
FIG. 4 is a cross-sectional view taken along line 4-4 of FIG. 3.

The installation of the electric terminal assembly 28 into the wire opening 36 will be described below in reference to FIGS. 4-7. Referring to FIG. 4, a cross-sectional view taken along the line 4-4 of FIG. 3 is shown. As previously described, the electric terminal assembly 28 is initially positioned for insertion into the wire opening 36.

Figure 5:
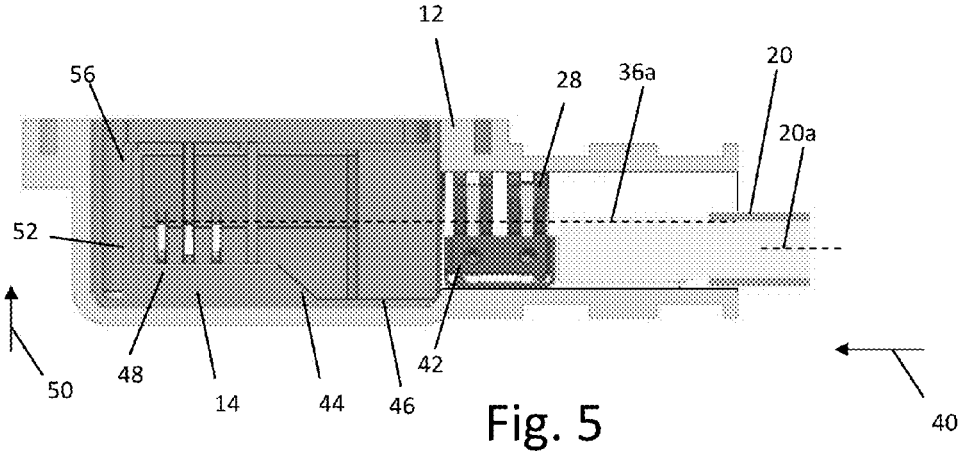
FIG. 5 is a cross-sectional view similar to FIG. 4 showing the terminal inserted into a wire opening defined by the connector body.
Figure 6:
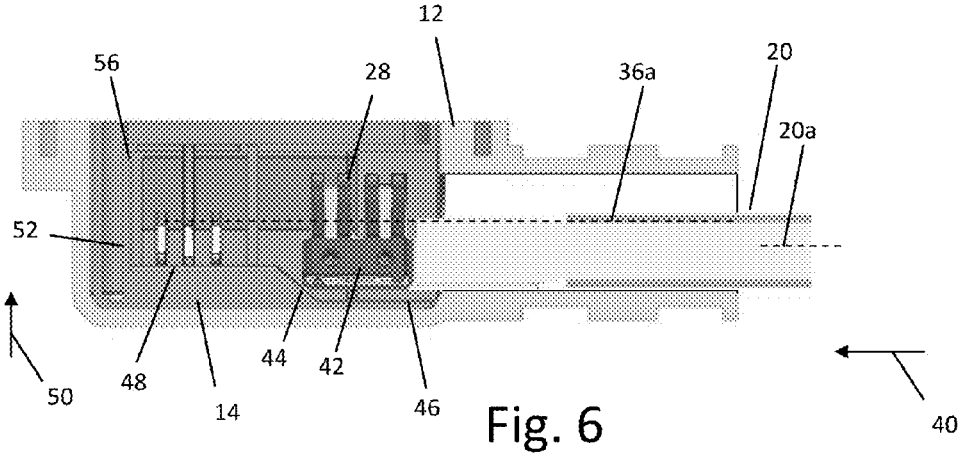
FIG. 6 is a cross-sectional view similar to FIG. 5 showing the terminal further inserted until it engages a terminal interface.

Referring to FIG. 5, a cross-sectional view similar to that shown in FIG. 4 is illustrated, where the electric terminal assembly 28 is shown moved in an insertion direction 40 into the wire opening 36. As best shown in FIGS. 5 and 6, the wire opening 36 is sized to accommodate a terminal body 42 of the electric terminal assembly 28 with minimal clearance. A portion of the wire 20 is located within the wire opening 36. As shown, the wire axis 20*a* of the wire 20 is located on a first side (below) of a wire opening axis 36*a* of the wire opening 36.

Referring to FIG. 6, a cross-sectional view similar to that shown in FIG. 5 is illustrated, where the electric terminal assembly 28 is shown moved further in the insertion direction 40. The terminal body 42 is no longer located within the wire opening 36, but rather is located within the insulator 14. The terminal body 42 is located over a rear surface 46 of the insulator 14. The rear surface 46 is an interior surface of the insulator 14 that is located far enough from the wire opening axis 36*a* to permit the terminal body 42 to exit the wire opening 36 and enter the insulator 14. The insulator 14 includes a terminal guide 44. As the electric terminal assembly 28 is moved in the insertion direction 40, it engages the terminal guide 44. The illustrated terminal guide 44 is a ramp that extends between the rear surface 46 of the insulator 14 and a terminal seat 48. The terminal seat 48 is an interior surface of the insulator 14 that is closer to the wire opening axis 36*a* than the rear surface 46. It should be appreciated that further movement of the electric terminal assembly 28 in the insertion direction 40 will cause the electric terminal assembly 28 to be moved away from the rear surface 46 in a seat direction 50 due to engagement with the terminal guide 44.

Figure 7:
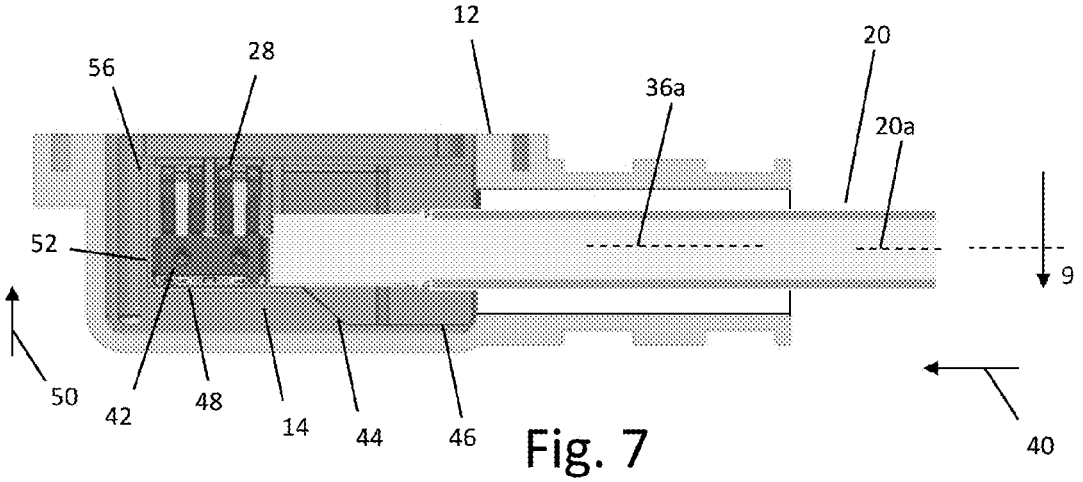
FIG. 7 is a cross-sectional view similar to FIG. 6 showing the terminal in a seated position.
Figure 8:
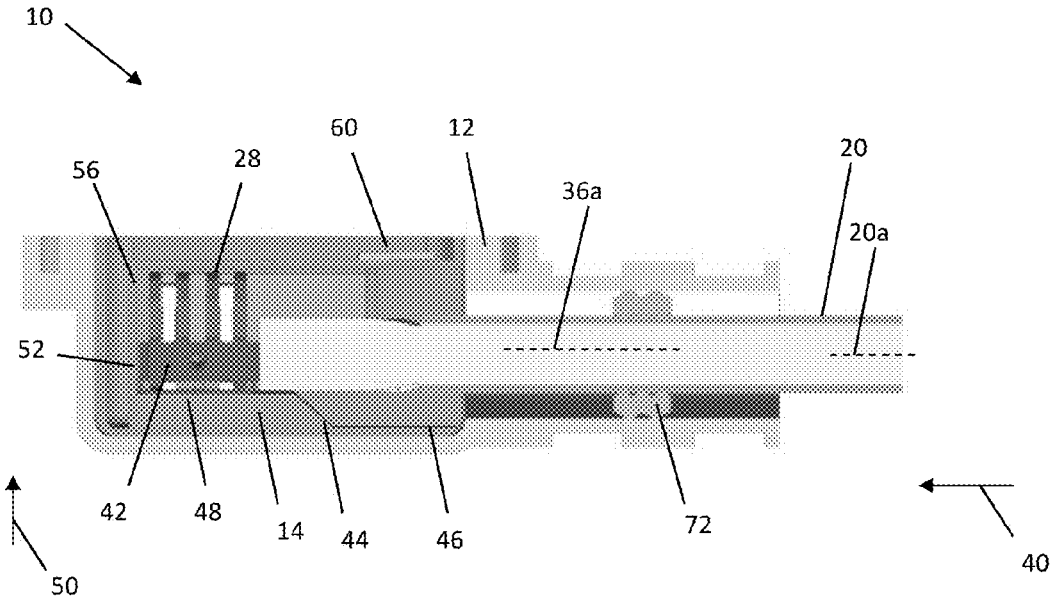
FIG. 8 is a cross-sectional view similar to FIG. 7 showing a terminal lock installed on the insulator.

Referring to FIG. 7, a cross-sectional view similar to that shown in FIG. 6 is illustrated, where the electric terminal assembly 28 is shown moved further in the insertion direction 40. As the electric terminal assembly 28 is moved in the insertion direction 40, the terminal guide 44 causes the electric terminal assembly 28 to move in the seat direction 50 until the terminal body 42 is located on the terminal seat 48. Once the electric terminal assembly 28 is on the terminal seat 48, it no longer engages the terminal guide 44 and may continue to be moved in the insertion direction 40 without moving further in the seat direction 50. The insulator 14 includes a stop 52 which prevents further movement of the electric terminal assembly 28 in the insertion direction 40. When the electric terminal assembly 28 engages the stop 52, the electric terminal assembly 28 is in a seated position within a terminal house 56 of the insulator 14. The illustrated stop 52 is an outer wall of the terminal house 56. As shown, when the electric terminal assembly 28 is in the seated position, the wire axis 20*a* is coaxial with the wire opening axis 36*a*, which means that the wire 20 is also coaxial with the wire opening 36. It should be appreciated that the other two electric terminal assemblies 26 and 30 are installed a manner similar to that previously described, and are located in terminal houses 54 and 58, respectively (shown in FIGS. 1, 3, 9, and 10).

The terminal lock 16 is then connected to the connector body 12. Referring back to FIG. 2, the terminal lock 16 includes a lock bar 60 and a retaining member 62 attached to the lock bar 60. The retaining member 62 serves to connect the terminal lock 16 to the connector body 12. The illustrated retaining member 62 includes a pair of pins that engage mounting holes 64 on the connector body 12. However, any other desired retaining member 62 may be used to attach the terminal lock 16 to the connector body 12. As seen in FIG. 1, the insulator 14 is located between the lock bar 60 and the connector body 12, and the terminal lock 16 retains the insulator 14 in position relative to the connector body 12. Referring back to FIG. 2, the terminal lock 16 also includes a plurality of lock tabs 66 that extend from the lock bar 60. The lock tabs 66 extend in the direction of the rear surface 46 of the insulator 14. The illustrated terminal lock 16 includes three lock tabs 66, which corresponds to the number of electric terminal assemblies 26, 28, and 30. However, the terminal lock 16 may have any desired number of lock tabs 66. The insulator 14 defines a plurality of tab openings 68 (best seen in FIG. 3), one in a wall of each of the terminal houses 54, 56, and 58. When the terminal lock 16 is connected to the connector body 12, each of the lock tabs 66 enters one of the tab openings 68.

Figure 9:
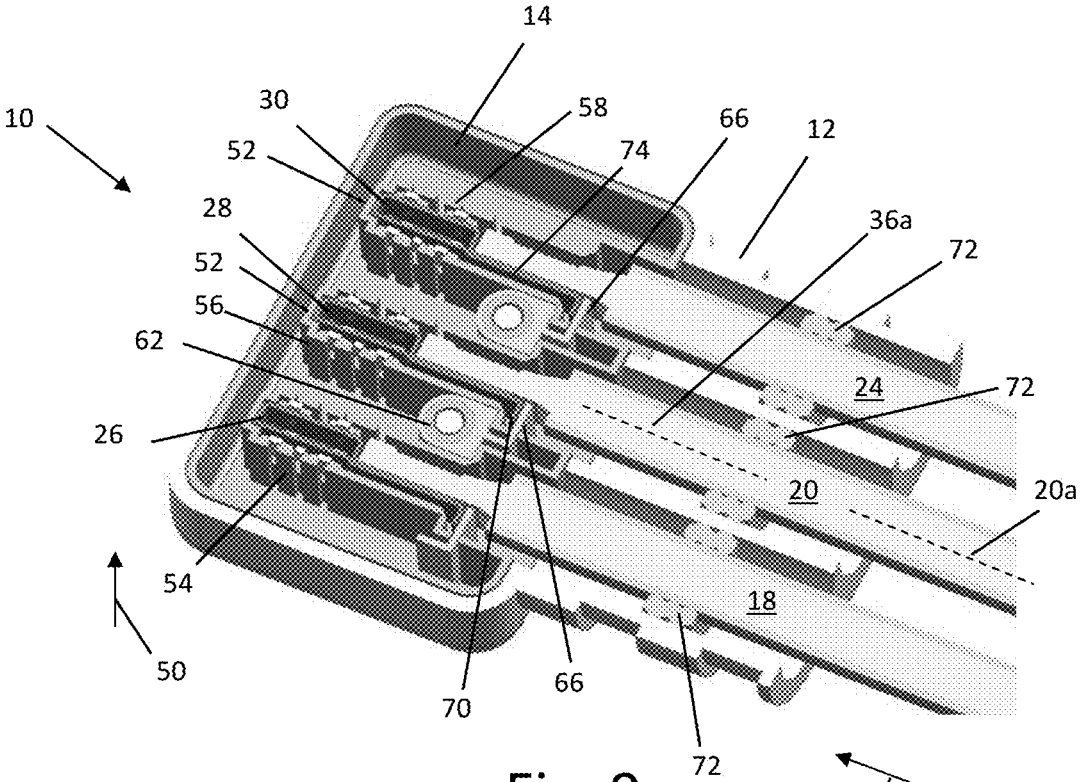
FIG. 9 is a cross-sectional view taken along line 9-9 of FIG. 1, showing the operation of the terminal lock.

In further reference to FIG. 3, the electric terminal assembly 28 includes a terminal tab 70. When the electric connector 10 is assembled, the terminal tab 70 engages one of the lock tabs 66 to prevent the electric terminal assembly 28 from being removed from the terminal house 56. This is best seen in FIG. 9, which is a cross-sectional view of the electric connector 10, taken along the line 9-9 of FIG. 1. As shown, each of the electric terminal assemblies 26, 28, and 30 includes a terminal tab 70. It should be appreciated that the electric terminal assemblies 26, 28, and 30 are blocked from moving in the direction opposite the insertion direction 40 by the engagement of the terminal tabs 70 with the respective lock tabs 66. Therefore, the terminal lock 16 serves to retain the electric terminal assemblies 26, 28, and 30 in their respective seated positions within the insulator 14. The electric connector 10 also includes wire opening seals 72 that seal the space between each of the wires 18, 20, and 24 and the connector body 12. The illustrated wire opening seals 72 are rubber O-rings that are located in each of the wire openings, including the wire opening 36, and engage the respective wires 18, 20, and 24. The circular cross-sectional shape of the wire opening 36 is advantageous in that is allows a rubber O-ring to be used as the wire opening seal 72. However, the wire opening seal 72 may be made of other materials or have any other desired shape.

Figure 10:
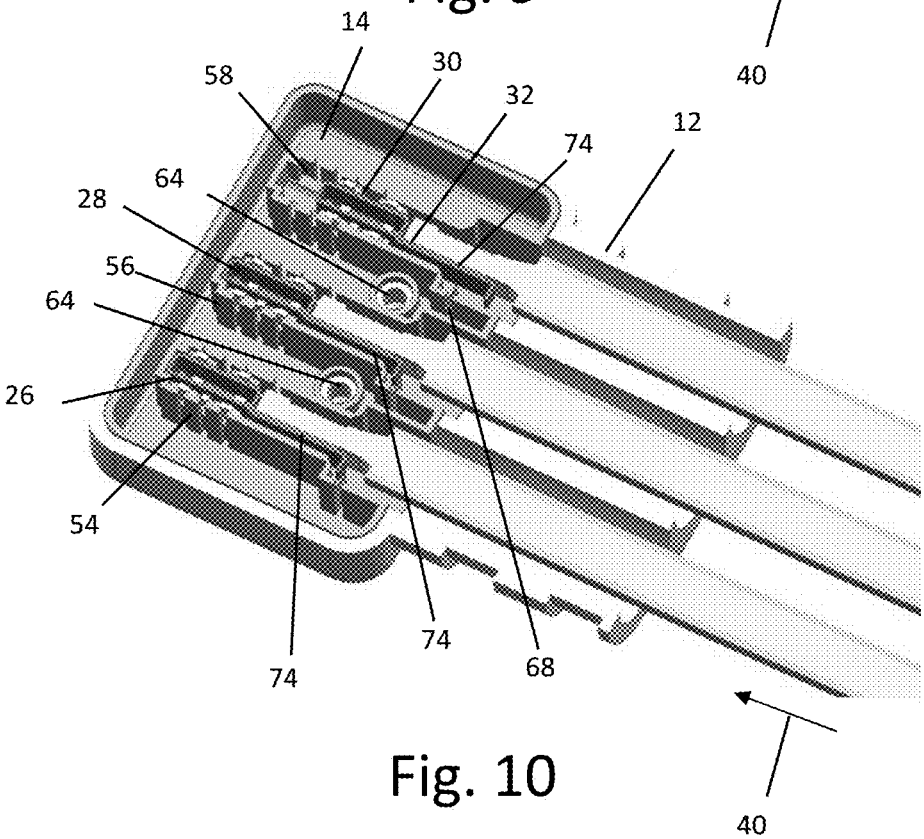
FIG. 10 is a cross-sectional view of the partially-assembled electric connector, showing one electric terminal not correctly installed in a seated position.

Referring now to FIG. 10, a cross-sectional view similar to that shown in FIG. 9 is illustrated, but showing the electric connector 10 in a partially-assembled state. As shown, the electric terminal assemblies 26 and 28 are in their respective seated positions within their respective terminal houses 54 and 56. However, the electric terminal assembly 30 is not in its seated position. The electric terminal assembly 30 has engaged the terminal guide 44 and is located within the terminal house 58, but needs to be moved farther in the insertion direction 40 in order to be in the seated position. The electric terminal assembly 30 is shown in a lock interference position. The electric terminal assembly 30 includes a lock block 74.

When the electric terminal assembly 30 is in the lock interference position, the lock block 74 is aligned with the tab opening 68 and obstructs the lock tab 66 from fully entering the terminal house 58 (as shown in FIG. 9). The illustrated lock block 74 is part of the termination portion 32 of the electric terminal assembly 30. However, the lock block 74 may be a separate piece of the terminal assembly 30 if desired. It should be appreciated that if the lock tab 66 is unable to fully enter the terminal house 58, then the retaining member 62 on the terminal lock 16 will be unable to engage the mounting holes 64 on the connector body 12. Thus, the terminal lock 16 will not be able to attach to the connector body 12, and the electric connector 10 cannot be fully assembled. Thus, the lock block 74 is a position assurance feature that helps insure that the electric terminal assembly 30 is properly positioned within the assembled electric connector 10. As shown in FIG. 9, when the electric connector 10 is properly assembled, the lock block 74 is located between the lock tab 66 and the stop 52. As shown, each of the electric terminal assemblies 26, 28, and 30 includes a lock block 74, and it should be appreciated that any of the electric terminal assemblies 26, 28, and 30 being out of the seated position will prevent assembly of the electric connector 10, as previously described.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A method of assembling an electric connector comprising the steps of:

inserting a terminal assembly with a wire attached thereto into a wire opening defined by a connector body in an insertion direction;

moving the terminal assembly in the insertion direction to engage a terminal guide that is located between a rear surface and a terminal seat within the connector body;

moving the terminal assembly relative to the connector body in a seat direction that is different from the insertion direction; and moving the terminal assembly in the insertion direction to a seated position.

2. The method of assembling an electric connector of claim 1, wherein the step of moving the terminal assembly relative to the connector body in a seat direction also involves simultaneously moving the terminal assembly in the insertion direction relative to the connector body.

3. The method of assembling an electric connector of claim 1, wherein when the terminal assembly is moved to the seated position, the wire is coaxial with the wire opening.

4. The method of assembling an electric connector of claim 1, wherein when the terminal assembly is inserted into the wire opening, the wire is not coaxial with the wire opening.

5. The method of assembling an electric connector of claim 1, further comprising the step of attaching a terminal lock to the connector body when the terminal assembly is moved to the seated position.

6. The method of assembling an electric connector of claim 5, further comprising the step of attaching a lock tab to the connector body when the terminal assembly is moved to the seated position.

7. The method of assembling an electric connector of claim 1, wherein the electric connector is a right angle connector.

8. An electric connector comprising:

a connector body defining a wire opening having a wire opening axis;

an insulator attached to the connector body, the insulator having a rear surface and a terminal seat, the terminal seat located closer to the wire opening axis than the rear surface, the insulator also having a terminal guide that extends between and is inclined relative to the rear surface and the terminal seat;

a terminal assembly located on the terminal seat; and a wire attached to the terminal assembly, the wire having a wire axis that is coaxial with the wire opening axis.

9. The electric connector of claim 8, further comprising a terminal lock including a lock tab that is located between the wire opening and a terminal tab on the terminal assembly.

10. The electric connector of claim 8, further comprising a terminal house defined by the insulator, wherein the terminal assembly is located within the terminal house.

11. The electric connector of claim 10, wherein a wall of the terminal house defines a tab opening; and further comprising a terminal lock including a lock bar that is located outside the terminal house and a lock tab that enters the tab opening.

12. The electric connector of claim 11, wherein the lock tab is located between the wire opening and a terminal tab on the terminal assembly.

13. The electric connector of claim 12, wherein the terminal assembly includes a lock block that is adapted to obstruct the lock tab from fully entering the terminal house when the terminal assembly is not in a seated position.

14. The electric connector of claim 13, wherein the terminal house extends between the wire opening and a stop, and wherein when the terminal assembly is in the seated position, the lock block is located between the lock tab and the stop.

15. The electric connector of claim 12, wherein the electric connector is a right angle connector.

16. The electric connector of claim 8, further comprising a terminal lock including a lock bar, the terminal lock attached to the connector body with the insulator located between the lock bar and the connector body.

17. The electric connector of claim 16, the terminal lock further comprising a lock tab extending from the lock bar, the lock tab located between the wire opening and a terminal tab on the terminal assembly.

18. The electric connector of claim 8, wherein the electric connector is a right angle connector.

19. A method of assembling an electric connector comprising the steps of:

moving a terminal assembly having a wire attached thereto in an insertion direction through a wire opening provided in a connector body until the terminal assembly engages a terminal guide that is located between a rear surface and a terminal seat provided in the connector body;

thereafter moving the terminal assembly along the terminal guide relative to the connector body in a direction that is different from the insertion direction; and thereafter moving the terminal assembly in the insertion direction until the terminal assembly reaches a seated position in the connector body.

* * * * *